US011821414B2

(12) United States Patent
Tanaka

(10) Patent No.: US 11,821,414 B2
(45) Date of Patent: Nov. 21, 2023

(54) FLUID CONTROL APPARATUS

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 101 days.

(21) Appl. No.: 17/455,051

(22) Filed: Nov. 16, 2021

(65) Prior Publication Data

US 2022/0074401 A1 Mar. 10, 2022

Related U.S. Application Data

(63) Continuation of application No. PCT/JP2020/019175, filed on May 14, 2020.

(30) Foreign Application Priority Data

Jul. 3, 2019 (JP) ..... 2019-124102

(51) Int. Cl.
*F04B 43/04* (2006.01)
*F04B 43/02* (2006.01)
(Continued)

(52) U.S. Cl.
CPC ..... *F04B 43/046* (2013.01); *F04B 43/0054* (2013.01); *F04B 43/028* (2013.01); *F04B 43/04* (2013.01); *F04B 45/047* (2013.01)

(58) Field of Classification Search
CPC ..... F04B 43/046; F04B 43/0054; F04B 43/028; F04B 43/04; F04B 45/047
See application file for complete search history.

(56) References Cited

U.S. PATENT DOCUMENTS

2006/0147329 A1 7/2006 Tanner
2017/0138357 A1 5/2017 Kondo et al.
2021/0355930 A1* 11/2021 Tanaka ..... F04B 45/047

FOREIGN PATENT DOCUMENTS

CN 201057136 Y 5/2008
JP 2008-527232 A 7/2008
(Continued)

OTHER PUBLICATIONS

International Search Report for International Patent Application No. PCT/JP2020/019175 dated Jun. 30, 2020.
(Continued)

*Primary Examiner* — Charles G Freay
(74) *Attorney, Agent, or Firm* — Pearne & Gordon LLP

(57) ABSTRACT

A fluid control apparatus (10) includes a first major plate (20), a piezoelectric device (30), a second major plate (40), a peripheral plate (50), a first film (61), and a second film (62). A space enclosed by the first major plate (20), the second major plate (40), and the peripheral plate (50) serves as a pump chamber (100) of the fluid control apparatus (10). A rectification base member (80) is provided between the first major plate (20) and the second major plate (40). The first film (61) is provided on the first major plate (20) and includes a movable portion positioned closer to the peripheral plate (50) than a fixed end thereof. The second film (62) is provided on a major surface (802) of the rectification base member (80) and includes a movable portion positioned across the fixed end thereof from the peripheral plate (50).

14 Claims, 6 Drawing Sheets

(51) Int. Cl.
*F04B 43/00* (2006.01)
*F04B 45/047* (2006.01)

(56) References Cited

FOREIGN PATENT DOCUMENTS

| | | | |
|---|---|---|---|
| JP | 2017-072140 | A | 4/2017 |
| WO | 2016/013390 | A1 | 1/2016 |
| WO | WO2019/230161 | A1 * | 5/2019 |

OTHER PUBLICATIONS

Written Opinion for International Patent Application No. PCT/JP2020/019175 dated Jun. 30, 2020.

* cited by examiner

FLUID CONTROL APPARATUS

CROSS REFERENCE TO RELATED APPLICATIONS

This is a continuation of International Application No. PCT/JP2020/019175 filed on May 14, 2020 which claims priority from Japanese Patent Application No. 2019-124102 filed on Jul. 3, 2019. The contents of these applications are incorporated herein by reference in their entireties.

BACKGROUND OF THE DISCLOSURE

Field of the Disclosure

The present disclosure relates to a fluid control apparatus utilizing a piezoelectric element.

Description of the Related Art

Hitherto, various fluid control apparatuses that transport fluids by utilizing piezoelectric elements have been developed, including the one disclosed by Patent Document 1.

The fluid control apparatus disclosed by Patent Document 1 includes a pump chamber and a valve chamber. The valve chamber includes a valve top plate, a valve bottom plate, and a film. The valve top plate and the valve bottom plate each have through-holes provided at positions not coinciding with the through-holes of the other plate. The valve chamber is connected to the pump chamber through the through-holes provided in the valve bottom plate.

The film is provided between the valve top plate and the valve bottom plate. The film has through-holes. The positions of the through-holes provided in the film coincide with the through-holes provided in the valve top plate. Therefore, when a fluid flows in from the pump chamber (through the through-holes of the valve bottom plate), the fluid is discharged to the outside through the through-holes of the film and the through-holes of the valve top plate. In contrast, when a fluid flows in from the through-holes of the valve top plate, the film closes the through-holes of the valve bottom plate, preventing the backflow of the fluid into the pump chamber. Thus, the fluid control apparatus disclosed by Patent Document 1 exerts a rectifying function.

Patent Document 1: Japanese Unexamined Patent Application Publication No. 2017-72140

BRIEF SUMMARY OF THE DISCLOSURE

In the fluid control apparatus disclosed by Patent Document 1, however, the path of the fluid is bent a plurality of times in the valve chamber. Therefore, it is not easy to achieve a high flow rate.

Accordingly, an object of the present disclosure is to provide a fluid control apparatus that achieves a high flow rate.

A fluid control apparatus according to the present disclosure includes a first major plate, a second major plate, a peripheral plate, and a pump chamber. The first major plate has a first major surface and a second major surface. The second major plate has a third major surface and a fourth major surface. The third major surface faces the first major surface. The peripheral plate connects the first major plate and the second major plate to each other. The pump chamber is a space enclosed by the first major plate, the second major plate, and the peripheral plate.

The first major plate includes a central portion, a frame portion provided around the circumference of the central portion, a supporting portion connected to the frame portion and to the central portion and supporting the central portion such that the central portion is vibratable, and a first opening. The first opening is provided between the central portion and the frame portion and connects the pump chamber and an outside area near the second major surface to each other. The second major plate includes a second opening. The second opening connects the pump chamber and an outside area near the fourth major surface to each other and is provided at a position at least partially coinciding with the supporting portion or the frame portion. The fluid control apparatus further includes a piezoelectric device provided on the central portion and that vibrates the central portion. The fluid control apparatus further includes a rectification base member, a first rectifying member, and a second rectifying member.

The rectification base member projects from an inner wall of the peripheral plate and is positioned between the first major plate and the second major plate. The first rectifying member is positioned between the first major plate and the rectification base member and controls the generation of the flow of a fluid in a space between the first major plate and the rectification base member in accordance with the vibration of the central portion. The second rectifying member is positioned between the second major plate and the rectification base member and controls the generation of the flow of the fluid in a space between the second major plate and the rectification base member in accordance with the vibration of the central portion and such that the direction of the flow is opposite to that controlled by the first rectifying member.

In the above configuration, the state of the apparatus is switchable in accordance with the vibration caused in the central portion of the first major plate, between a state where the pump chamber is connected to the first opening but is disconnected from (closed to or separated from) the second opening and a state where the pump chamber is connected to the second opening but is disconnected from (closed to or separated from) the first opening. In such a configuration, the path of the fluid is not complicatedly bent. Therefore, the flow rate is less likely to be reduced.

According to the present disclosure, a fluid control apparatus that achieves a high flow rate is provided.

DETAILED DESCRIPTION OF THE DISCLOSURE

First Embodiment

Figure 1:
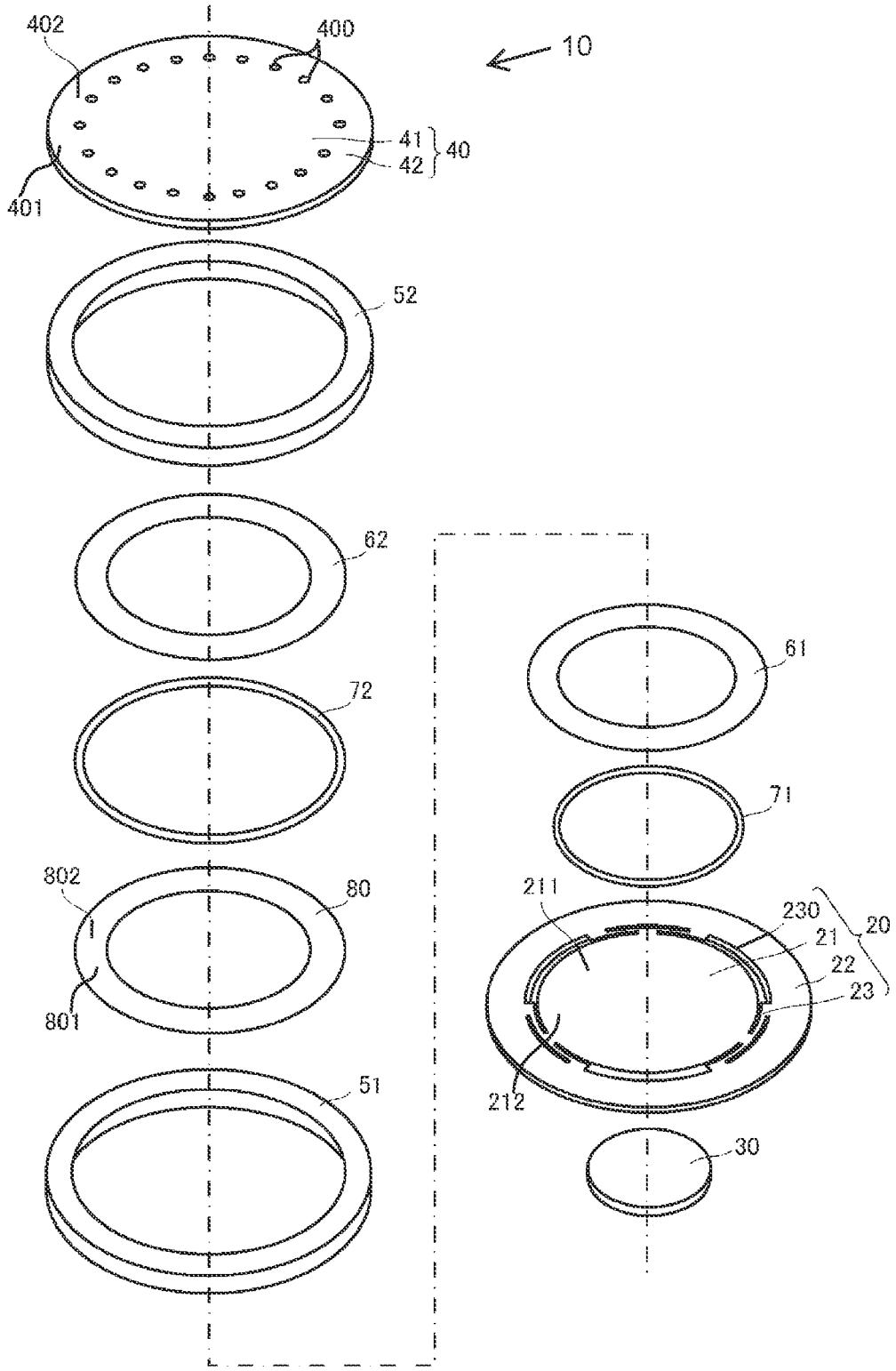
FIG. 1 is an exploded perspective view of a fluid control apparatus according to a first embodiment.
Figure 2A:
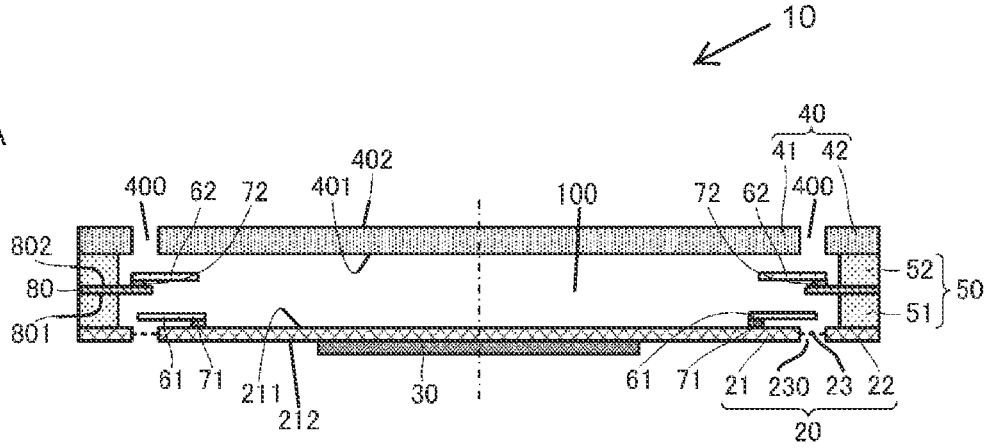
FIG. 2A is a sectional view of the fluid control apparatus according to the first embodiment.
Figure 2B:
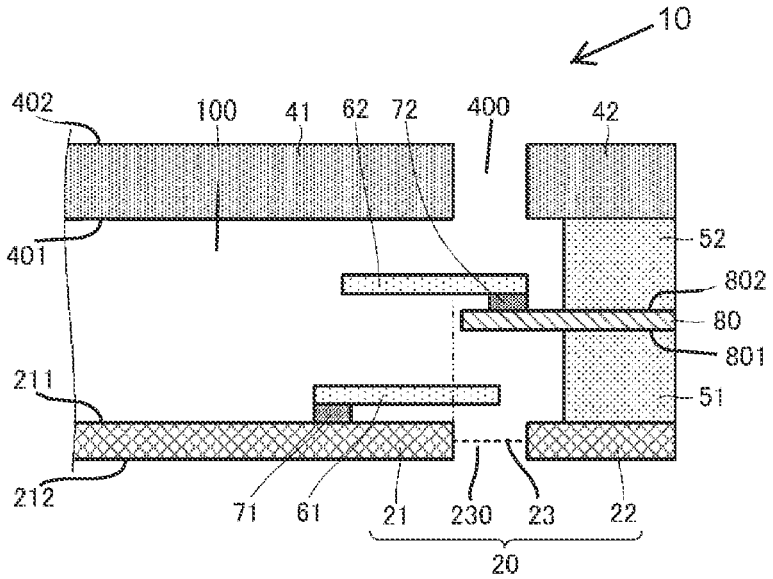
FIG. 2B is an enlarged sectional view of a part where a rectifying function is to be exerted.
Figure 3A:
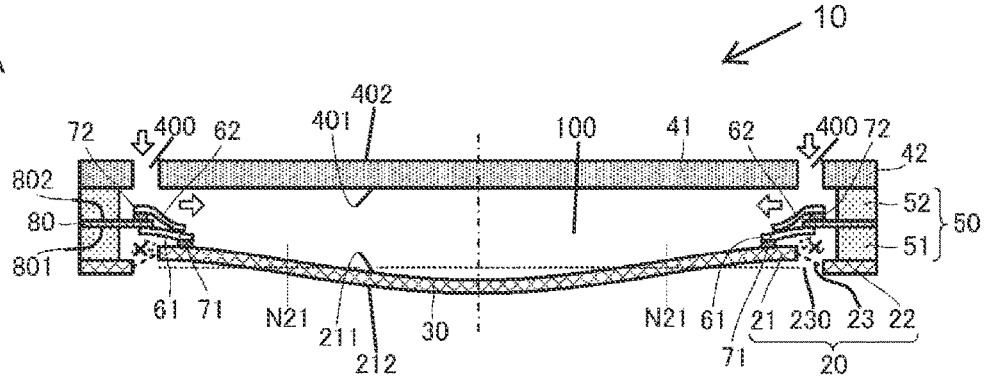
FIGS. 3A and 3B are side sectional views illustrating how a central portion of a first major plate, a first film and a second film behave.
Figure 3B:
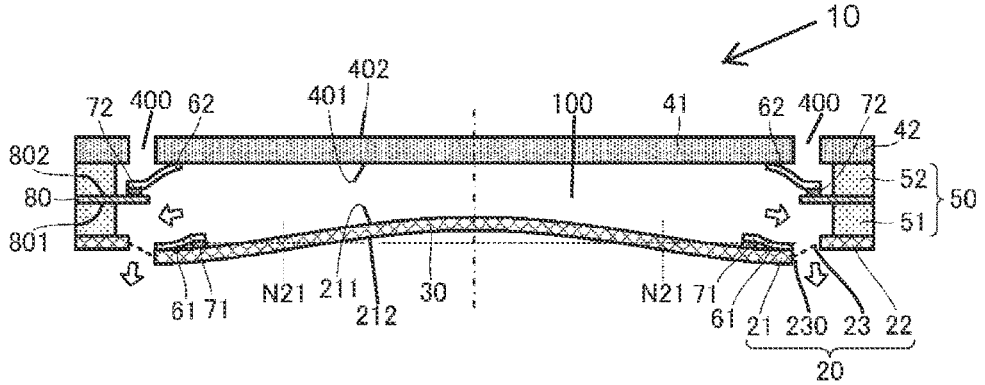

A fluid control apparatus according to a first embodiment of the present disclosure will now be described with reference to the drawings. FIG. 1 is an exploded perspective view of a fluid control apparatus according to the first embodiment. FIG. 2A is a sectional view of the fluid control apparatus according to the first embodiment. FIG. 2B is an enlarged sectional view of a part where a rectifying function is to be exerted. FIGS. 3A and 3B are side sectional views illustrating how a central portion of a first major plate and a first film behave. In the drawings to be referred to in the following description of embodiments, the shapes of relevant elements are partially or generally exaggerated for easy understanding of the description. For easy reading of the drawings, reference signs of some elements that are uniquely assumable are omitted.

Configuration of Fluid Control Apparatus 10

As illustrated in FIGS. 1, 2A, and 2B, the fluid control apparatus 10 includes a first major plate 20, a piezoelectric device 30, a second major plate 40, a peripheral plate 50, a first film 61, a second film 62, a fixing member 71, a fixing member 72, and a rectification base member 80. The peripheral plate 50 includes a peripheral plate 51 and a peripheral plate 52.

The first major plate 20 is a flat plate having a circular plan-view shape. The first major plate 20 has a first major surface 211 and a second major surface 212, each of which has a circular shape. The first major surface 211 and the second major surface 212 are positioned opposite to each other.

The first major plate 20 includes a central portion 21, a frame portion 22, a supporting portion 23, and a first opening 230. The central portion 21 has a circular plan-view shape. The frame portion 22 has an annular shape. The frame portion 22 extends along the circumference of the central portion 21 and surrounds the central portion 21.

The supporting portion 23 and the first opening 230 extend along the circumferential end of the central portion 21 and between the central portion 21 and the frame portion 22. The first opening 230 is a cut extending through the first major plate 20 between the first major surface 211 and the second major surface 212.

The supporting portion 23 connects the circumferential end of the central portion 21 and the inner circumferential end of the frame portion 22 to each other. The supporting portion 23 is, for example, one of a plurality of supporting portions 23. In the embodiment illustrated in FIG. 1, the plurality of supporting portions 23 are provided at intervals of 90° along the circumference of the central portion 21. In the fluid control apparatus 10, the supporting portions 23 section the cut (the first opening 230) into a plurality of first openings 230 at any positions in the circumferential direction. The width and shape of the supporting portions 23 are determined according to need, whereby the central portion 21 is vibratable with respect to the frame portion 22. In other words, the supporting portions 23 support the central portion 21 such that the central portion 21 is vibratable with respect to the frame portion 22.

The central portion 21 preferably has a circular shape but may have a substantially circular shape such as an oval shape, or a polygonal shape. The outline shape of the frame portion 22, i.e., the outline shape of the first major plate 20, is not limited to a circular shape and may be determined according to need in coordination with the outline shape of the fluid control apparatus 10.

The first major plate 20 is made of metal, for example. The first major plate 20 only needs to be capable of undergoing bending vibration in the central portion 21 thereof when the piezoelectric device 30, to be described below, is strained. Bending vibration refers to vibration in which the first major surface 211 and the second major surface 212 are displaced in such a manner as to wave in a side view of the central portion 21, as illustrated in FIGS. 3A and 3B.

The piezoelectric device 30 includes a disc-shaped piezoelectric element and driving electrodes. The driving electrodes are provided on the two major surfaces, respectively, of the disc-shaped piezoelectric element.

The piezoelectric device 30 is provided on the second major surface 212 of the first major plate 20 at the central portion 21. In plan view, the center of the piezoelectric device 30 and the center of the central portion 21 substantially coincide with each other. The piezoelectric device 30 is strained when a driving signal is applied to the driving electrodes thereof. With the strain, the central portion 21 vibrates as described above.

The second major plate 40 is a flat plate having a circular plan-view shape. The material, thickness, and other relevant factors of the second major plate 40 are preferably determined such that the second major plate 40 undergoes substantially no bending vibration. The outline shape of the second major plate 40 is large enough to cover the outline shape of the first major plate 20. The second major plate 40 has a third major surface 401 and a fourth major surface 402, each of which has a circular shape. The third major surface 401 and the fourth major surface 402 are positioned opposite to each other.

The second major plate 40 has a plurality of second openings 400. The plurality of second openings 400 are cylindrical through-holes extending through the second major plate 40 between the third major surface 401 and the fourth major surface 402. The plurality of second openings 400 are arranged on the circumference of a circle having the origin thereof at the center of the second major plate 40.

Generally, the plurality of second openings 400 are provided near the circumferential end of the second major plate 40. For example, in a plan view of the fluid control apparatus 10 (when seen in a direction orthogonal to the major surfaces of the first major plate 20 and the second major plate 40), the plurality of second openings 400 partially coincide with the frame portion 22 of the first major plate 20 or an area where the supporting portions 23 and the first openings 230 are provided. With respect to the plurality of second openings 400, a portion of the second major plate 40 that is on the center side serves as a central portion 41, and a portion of the second major plate 40 that is on the outer side serves as a peripheral portion 42.

The second major plate 40 is positioned such that the major surfaces thereof extend parallel to the major surfaces of the first major plate 20. In this state, the third major surface 401 of the second major plate 40 and the first major surface 211 of the first major plate 20 face each other.

Furthermore, the plan-view center of the second major plate 40 and the plan-view center of the central portion 21 of the first major plate 20 substantially coincide with each other.

As with the case of the first major plate 20, the outline shape of the second major plate 40 is not limited to a circular shape and may be determined according to need in coordination with the outline shape of the fluid control apparatus 10.

The peripheral plate 51 and the peripheral plate 52 are each an annular column. The materials, thicknesses, and other relevant factors of the peripheral plate 51 and the peripheral plate 52 are preferably determined such that the peripheral plates 51 and 52 undergo substantially no bending vibration.

The peripheral plate 51 and the peripheral plate 52 are positioned between the first major plate 20 and the second major plate 40. One height-direction end of the peripheral plate 51 is connected to the first major surface 211 of the first major plate 20 at the frame portion 22. The other height-direction end of the peripheral plate 51 is connected to one height-direction end of the peripheral plate 52 with the rectification base member 80, to be described below, interposed therebetween. The other height-direction end of the peripheral plate 52 is connected to the third major surface 401 of the second major plate 40 at the peripheral portion 42.

The fluid control apparatus 10 configured as above has a space enclosed by the first major plate 20, the second major plate 40, and the peripheral plate 50 (including the rectification base member 80, exactly). The space serves as a pump chamber 100 of the fluid control apparatus 10.

The rectification base member 80 is an annular flat plate. The rectification base member 80 has a major surface 801 and a major surface 802, which are positioned opposite to each other. The material, thickness, and other relevant factors of the rectification base member 80 are preferably determined such that the rectification base member 80 undergoes substantially no bending vibration. The inner-end (inner-circumferential) diameter (inside diameter) of the rectification base member 80 is smaller than each of the inside diameters of the peripheral plate 51 and the peripheral plate 52 and is greater than the diameter of the central portion 21 of the first major plate 20. The outer-end (outer-circumferential) diameter (outside diameter) of the rectification base member 80 is, for example, substantially equal to each of the outside diameters of the peripheral plate 51 and the peripheral plate 52.

The rectification base member 80 is held between the peripheral plate 51 and the peripheral plate 52. The major surface 801 of the rectification base member 80 is connected to the peripheral plate 51. The major surface 802 of the rectification base member 80 is connected to the peripheral plate 52. In this state, the inner end of the rectification base member 80 projects inward (toward the pump chamber 100) with respect to the inner ends of the peripheral plate 51 and the peripheral plate 52 over the entire circumference thereof.

The first film 61 has an annular shape. The first film 61 is made of a flexible material and bends when receiving an external force. The inner-end (inner-circumferential) diameter (inside diameter) of the first film 61 is smaller than the diameter of the central portion 21 of the first major plate 20. The outer-end (outer-circumferential) diameter (outside diameter) of the first film 61 is greater than the diameter of the central portion 21 of the first major plate 20.

The fixing member 71 has an annular shape. The inside diameter of the fixing member 71 is substantially equal to the inside diameter of the first film 61. The outside diameter of the fixing member 71 is smaller than the outside diameter of the first film 61 and is smaller than the diameter of the central portion 21 of the first major plate 20.

The first film 61 is fixed to the first major surface 211 of the first major plate 20 with the fixing member 71 interposed therebetween. The first film 61 is fixed to the central portion 21. The center of the first film 61 substantially coincides with the center of the central portion 21.

Specifically, a portion of the first film 61 that is at the inner end and has a predetermined area is fixed to the first major plate 20 with the fixing member 71 interposed therebetween. Therefore, the other portion of the first film 61 that is on the outer side and is not connected to the fixing member 71 serves as a movable portion of the first film 61. That is, the inner end of the first film 61 serves as a fixed end of the first film 61, and an annular portion of the first film 61 that is on the outer side with respect to the fixed end serves as the movable portion of the first film 61. Furthermore, the outer end (movable end) of the first film 61 is positioned closer to the peripheral plate 51 than (on the outer side with respect to) the circumferential end of the central portion 21 of the first major plate 20 and the inner end of the rectification base member 80.

The second film 62 has an annular shape. The second film 62 is made of a flexible material and bends when receiving an external force. The inner-end (inner-circumferential) diameter (inside diameter) of the second film 62 is smaller than the diameter of the central portion 41 of the second major plate 40. The outer-end (outer-circumferential) diameter (outside diameter) of the second film 62 is greater than the diameter of the central portion 41 of the second major plate 40.

The fixing member 72 has an annular shape. The outside diameter of the fixing member 72 is substantially equal to the outside diameter of the second film 62. The inside diameter of the fixing member 72 is greater than each of the inside diameter of the second film 62 and the inside diameter of the rectification base member 80.

The second film 62 is fixed to the major surface 802 of the rectification base member 80 with the fixing member 72 interposed therebetween. The center of the second film 62 substantially coincides with the center of the rectification base member 80.

Specifically, a portion of the second film 62 that is at the outer end and has a predetermined area is fixed to the rectification base member 80 with the fixing member 72 interposed therebetween. Therefore, the other portion of the second film 62 that is on the inner side and is not connected to the fixing member 72 serves as a movable portion of the second film 62. That is, the outer end of the second film 62 serves as a fixed end of the second film 62, and an annular portion of the second film 62 that is on the inner side with respect to the fixed end serves as the movable portion of the second film 62. The outer end (fixed end) of the second film 62 is positioned closer to the peripheral plate 51 than (on the outer side with respect to) the circumferential end of the central portion 41 of the second major plate 40.

Specific Description of Rectifying Function

In the above configuration, when the central portion 21 vibrates, the fluid control apparatus 10 alternately takes a first state illustrated in FIG. 3A and a second state illustrated in FIG. 3B, generally.

1. How Fluid Flows from Outside into Pump Chamber

In the first state illustrated in FIG. 3A, a part of the central portion 21 that is on the center side with respect to a node N21 is displaced away from the second major plate 40. Meanwhile, a part of the central portion 21 that is on the outer side with respect to the node N21 is displaced toward the second major plate 40. Therefore, a space on the center side of the central portion 21 comes to have a pressure lower than (negative to) the pressure on the outside of the fluid control apparatus 10.

Since the space on the center side of the central portion 21 has a low (negative) pressure, the fluid in an area outside the fluid control apparatus 10 and near the second major plate 40 moves to flow into the pump chamber 100 through the second openings 400.

Here, as described above, the second film 62 is fixed at the outer end thereof, with the inner portion thereof serving as the movable portion. Hence, as illustrated in FIG. 3A, when the fluid flows in through the second openings 400, the second film 62 bends toward the rectification base member 80. Accordingly, the second openings 400 and a central area (a space on the center side with respect to the second film 62) of the pump chamber 100 are connected to each other. Therefore, the fluid in the area outside the fluid control apparatus 10 and near the second major plate 40 flows into the pump chamber 100 through the second openings 400.

Meanwhile, as described above, the first film 61 is fixed at the inner end thereof, with the outer portion thereof serving as the movable portion. Hence, as illustrated in FIG. 3A, when the fluid flows in through the first openings 230, the first film 61 bends away from the first major plate 20 and comes into contact with the major surface 801 of the rectification base member 80. Accordingly, the first openings 230 and the central area of the pump chamber 100 are not connected to each other. In other words, the first openings 230 and the central area of the pump chamber 100 are spatially closed to each other and separated from each other. Therefore, the fluid in an area outside the fluid control apparatus 10 and near the first major plate 20 is prevented from flowing into the pump chamber 100 through the first openings 230.

2. How Fluid is Discharged from Pump Chamber to Outside

In the second state illustrated in FIG. 3B, the part of the central portion 21 that is on the center side with respect to the node N21 is displaced toward the second major plate 40. Meanwhile, the part of the central portion 21 that is on the outer side with respect to the node N21 is displaced away from the second major plate 40. Therefore, the space on the center side of the central portion 21 comes to have a pressure higher than (positive to) the pressure on the outside of the fluid control apparatus 10.

Since the space on the center side of the central portion 21 has a high (positive) pressure, the fluid in the pump chamber 100 of the fluid control apparatus 10 moves to flow out of the fluid control apparatus 10 through the first openings 230 and the second openings 400.

Here, as described above, the first film 61 is fixed at the inner end thereof, with the outer portion thereof serving as the movable portion. Hence, as illustrated in FIG. 3B, when the fluid inside flows toward the first openings 230, the first film 61 bends toward the first major plate 20. Accordingly, the central area (the space on the center side with respect to the first film 61) of the pump chamber 100 and the first openings 230 are connected to each other. Therefore, the fluid in the pump chamber 100 is discharged to the area outside the fluid control apparatus 10 and near the first major plate 20 through the first openings 230.

Meanwhile, as described above, the second film 62 is fixed at the outer end thereof, with the inner portion thereof serving as the movable portion. Hence, as illustrated in FIG. 3B, when the fluid inside flows toward the second openings 400, the second film 62 comes into contact with the third major surface 401 of the second major plate 40 at the central portion 41. Accordingly, the central area of the pump chamber 100 and the second openings 400 are not connected to each other. In other words, the central area of the pump chamber 100 and the second openings 400 are spatially closed to each other and separated from each other. Therefore, the fluid in the pump chamber 100 is prevented from being discharged to the area outside the fluid control apparatus 10 and near the second major plate 40.

With such a configuration, the fluid control apparatus 10 is capable of causing the fluid to flow from the outside area near the second major plate 40 to the outside area near the first major plate 20 by using a first rectifying member, which is formed of the first film 61 and the fixing member 71, and a second rectifying member, which is formed of the second film 62 and the fixing member 72. Furthermore, since the fluid control apparatus 10 is configured as above, the fluid is transported along a path that is not complicatedly bent. Consequently, the loss that may occur during the transportation of the fluid is reduced, and the fluid control apparatus 10 achieves a high flow rate.

In the fluid control apparatus 10, the first film 61 is positioned on the outer side with respect to the node N21 of vibration of the central portion 21. Therefore, in the state where the first openings 230 and the central area of the pump chamber 100 are closed to each other, the part of the central portion 21 where the first film 61 is provided is displaced toward the rectification base member 80. Hence, the first film 61 is easily brought into contact with the major surface 801 of the rectification base member 80. Consequently, in the fluid control apparatus 10, the backflow of the fluid from the first openings 230 is prevented more assuredly.

In the other state where the first openings 230 and the central area of the pump chamber 100 are connected to each other, the part of the central portion 21 where the first film 61 is provided is displaced away from the rectification base member 80. Therefore, the gap between the first film 61 and the rectification base member 80 is widened, that is, the size of the opening therebetween is increased. Accordingly, the flow rate at the time of discharge is increased.

With the above configuration, the fluid control apparatus 10 achieves a higher flow rate.

In the fluid control apparatus 10, the inner end of the rectification base member 80 is positioned on the outer side with respect to (nearer to the peripheral plate than) the outer end of the central portion 21 of the first major plate 20. Therefore, even when the central portion 21 vibrates, the central portion 21 does not interfere with the rectification base member 80. Thus, the fluid control apparatus 10 achieves high reliability and a high flow rate simultaneously.

Second Embodiment

Figure 4:
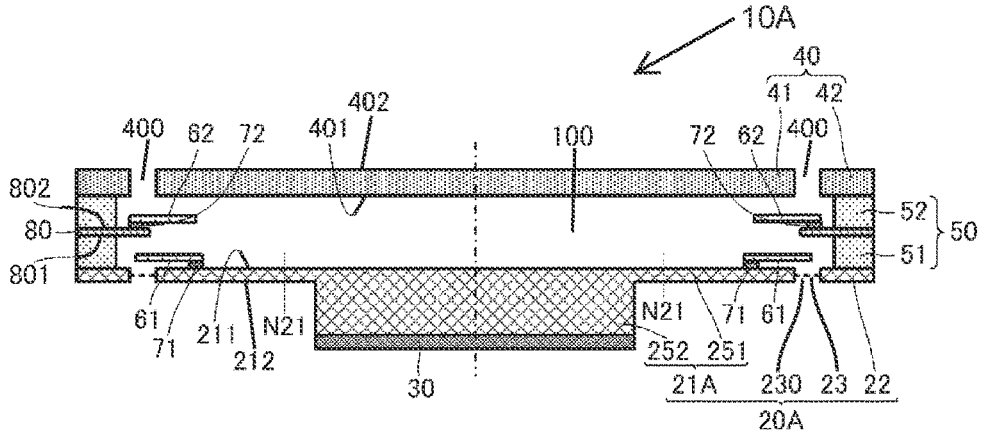
FIG. 4 is a sectional view of a fluid control apparatus according to a second embodiment.

A fluid control apparatus according to a second embodiment will now be described with reference to the drawing. FIG. 4 is a sectional view of the fluid control apparatus according to the second embodiment.

As illustrated in FIG. 4, the fluid control apparatus 10A according to the second embodiment is different from the fluid control apparatus 10 according to the first embodiment in the shape of the central portion 21A of the first major plate, 20A. The other details of the fluid control apparatus 10A are the same as those of the fluid control apparatus 10, and the description of such details is omitted.

The central portion 21A of the first major plate 20A includes a first region 251 and a second region 252. The second region 252 is thicker than the first region 251. The second region 252 projects from the second major surface 212 with respect to the first region 251, whereby the thickness difference is produced. The average thickness of the central portion 21A is greater on the inner side with respect to the node N21 of vibration than on the outer side with respect to the node N21. The piezoelectric device 30 is provided on the second region 252. The position of the node N21 is detectable with a device such as a laser displacement gauge that utilizes the Doppler effect.

With such a configuration, the vibration waveform of the central portion 21A (the way of deformation of the central portion 21A) is controllable. Specifically, the displacement of the central portion 21A due to vibration is greater near the circumference. Thus, the deformation of the first film 61 is promoted, and the efficiency of rectification by the fluid control apparatus 10A is increased. Consequently, the fluid control apparatus 10A achieves a higher flow rate.

Third Embodiment

Figure 5:
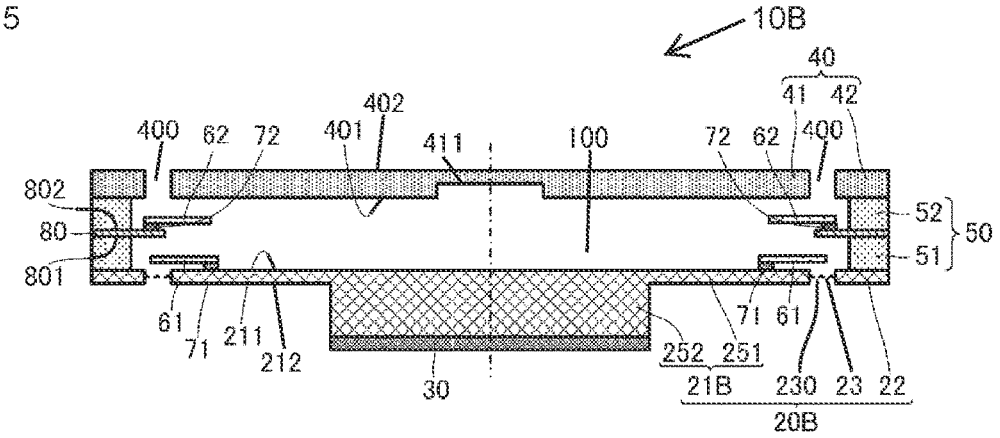
FIG. 5 is a sectional view of a fluid control apparatus according to a third embodiment.

A fluid control apparatus according to a third embodiment will now be described with reference to the drawing. FIG. 5 is a sectional view of the fluid control apparatus according to the third embodiment.

As illustrated in FIG. 5, the fluid control apparatus, 10B, according to the third embodiment is different from the fluid control apparatus 10A according to the second embodiment in the configuration of the second major plate 40. The other details of the fluid control apparatus 10B are the same as those of the fluid control apparatus 10A, and the description of such details is omitted. A central portion 21B of the fluid control apparatus 10B is the same as the central portion 21A of the fluid control apparatus 10A.

The second major plate 40 has a recess 411. The recess 411 is a depression that is open in the third major surface 401 of the second major plate 40 in the central portion 41. The space provided in the recess 411 has a round columnar shape. The recess 411 is continuous with the pump chamber 100.

Such a configuration suppresses the interference between the central portion 21B and the second major plate 40 that may occur when the central portion 21B vibrates. Consequently, the fluid control apparatus 10B has improved durability with low noise.

Fourth Embodiment

Figure 6A:
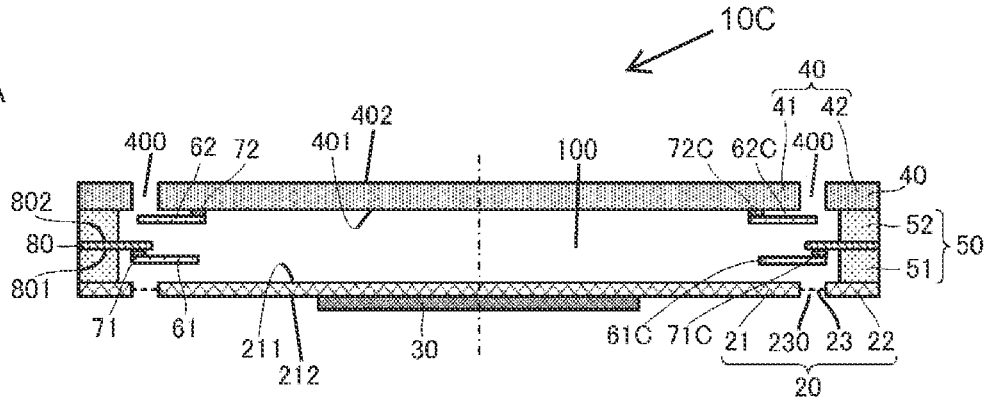
FIG. 6A is a sectional view of a fluid control apparatus according to a fourth embodiment.
Figure 6B:
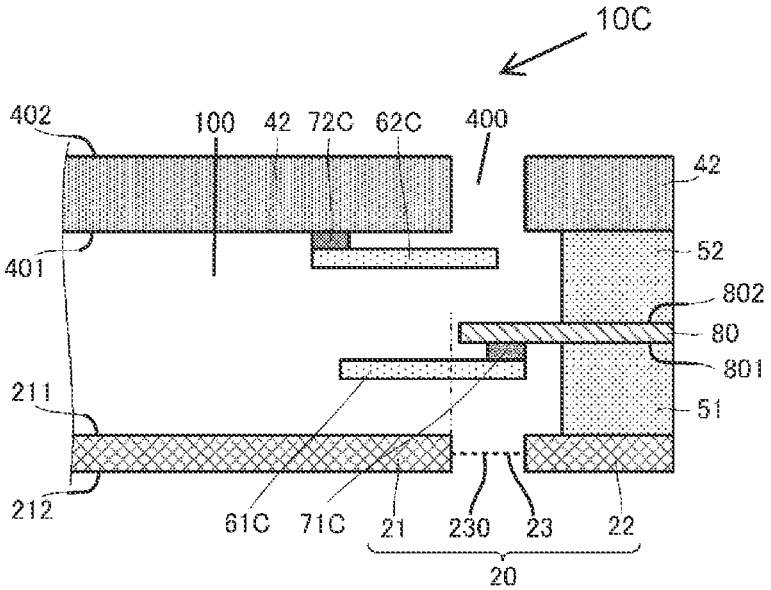
FIG. 6B is an enlarged sectional view of a part where a rectifying function is to be exerted.

A fluid control apparatus according to a fourth embodiment will now be described with reference to the drawings. FIGS. 6A and 6B are sectional views of the fluid control apparatus according to the fourth embodiment.

As illustrated in FIGS. 6A and 6B, the fluid control apparatus 10C according to the fourth embodiment is different from the fluid control apparatus 10 according to the first embodiment in the shapes and the ways of fixing of the first film 61C, and the second film 62C. The other details of the fluid control apparatus 10C are the same as those of the fluid control apparatus 10, and the description of such details is omitted.

The fluid control apparatus 10C includes the first film 61C, the second film 62C, a fixing member 71C, and a fixing member 72C.

The first film 61C has an annular shape. The first film 61C is made of a flexible material and bends when receiving an external force. The inner-end (inner-circumferential) diameter (inside diameter) of the first film 61C is smaller than the diameter of the central portion 21 of the first major plate 20. The outer-end (outer-circumferential) diameter (outside diameter) of the first film 61C is greater than each of the diameter of the central portion 21 of the first major plate 20 and the inside diameter of the rectification base member 80, and is smaller than each of the inside diameters of the peripheral plate 51 and the peripheral plate 52.

The fixing member 71C has an annular shape. The inside diameter of the fixing member 71C is greater than each of the inside diameter of the first film 61C and the inside diameter of the rectification base member 80. The outside diameter of the fixing member 71C is substantially equal to the outside diameter of the first film 61C.

The first film 61C is fixed to the major surface 801 of the rectification base member 80 with the fixing member 71C interposed therebetween.

Specifically, a portion of the first film 61C that is at the outer end and has a predetermined area is fixed to the rectification base member 80 with the fixing member 71C interposed therebetween. Therefore, the other portion of the first film 61C that is on the inner side and is not connected to the fixing member 71C serves as a movable portion of the first film 61C. That is, the outer end of the first film 61C serves as a fixed end of the first film 61C, and an annular portion of the first film 61C that is on the inner side with respect to the fixed end serves as the movable portion of the first film 61C. The inner end (movable end) of the first film 61C is positioned on the center side with respect to the circumferential end of the central portion 21 of the first major plate 20.

The second film 62C has an annular shape. The second film 62C is made of a flexible material and bends when receiving an external force. The inner-end (inner-circumferential) diameter (inside diameter) of the second film 62C is smaller than the diameter of the central portion 41 of the second major plate 40. The outer-end (outer-circumferential) diameter (outside diameter) of the second film 62C is greater than each of the diameter of the central portion 41 of the second major plate 40 and the inside diameter of the rectification base member 80.

The fixing member 72C has an annular shape. The inside diameter of the fixing member 72C is substantially equal to the inside diameter of the second film 62C. The outside diameter of the fixing member 72C is smaller than each of the outside diameter of the second film 62C, the outside diameter of the central portion 41 of the second major plate 40, and the inside diameter of the rectification base member 80.

The second film 62C is fixed to the third major surface 401 of the second major plate 40 at the central portion 41 with the fixing member 72C interposed therebetween. The center of the second film 62C substantially coincides with the center of the central portion 41 of the second major plate 40.

Specifically, a portion of the second film 62C that is at the inner end and has a predetermined area is fixed to the central portion 41 of the second major plate 40 with the fixing member 72C interposed therebetween. Therefore, the other portion of the second film 62C that is on the outer side and is not connected to the fixing member 72C serves as a movable portion of the second film 62C. That is, the inner end of the second film 62 serves as a fixed end of the second film 62C, and an annular portion of the second film 62C that is on the outer side with respect to the fixed end serves as the movable portion of the second film 62C. The outer end (movable end) of the second film 62C is positioned closer to the peripheral plate 52 than (on the outer side with respect to) the inner end of the rectification base member 80.

In such a configuration, to allow the fluid to flow in, the first film 61C does not come into contact with the first major plate 20, whereas the second film 62C comes into contact with the rectification base member 80. Thus, the fluid control apparatus 10C allows the fluid to flow into the pump chamber 100 from the outside area near the first major plate 20.

On the other hand, to discharge the fluid, the second film 62C moves away from the rectification base member 80, whereas the first film 61C comes into contact with the first major surface 211 of the first major plate 20 at the central portion 21. Thus, the fluid control apparatus 10C discharges the fluid from the pump chamber 100 to the outside area near the second major plate 40.

In the above manner, the fluid control apparatus 10C achieves rectification in a direction opposite to the direction of rectification achieved by the fluid control apparatus 10 according to the first embodiment. Furthermore, as with the fluid control apparatus 10, the fluid control apparatus 10C achieves a high flow rate.

Exemplary Shapes of Supporting Portions

The shape of the supporting portions, which has not been described in detail above, may be any of those illustrated in FIGS. 7A, 7B, 7C, 7D, and 7E, for example. FIGS. 7A, 7B, 7C, 7D, and 7E are plan views of first major plates, illustrating different arrangements of supporting portions and elements therearound.

Figure 7A:
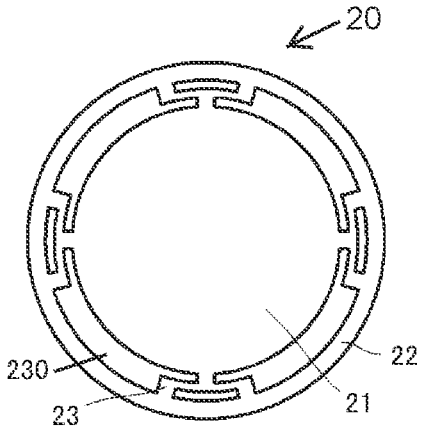
FIGS. 7A, 7B, 7C, 7D, and 7E are plan views of first major plates, illustrating different arrangements of supporting portions and elements therearound.

FIG. 7A illustrates the first major plate 20 configured as illustrated in FIG. 1. The supporting portions 23 of the first major plate 20 include first segments connected to the central portion 21, second segments connected to the frame portion 22, and third segments connecting the first segments and the second segments to each other. The first segments and the second segments each extend in such a direction as to connect the circumferential end of the central portion 21 and the frame portion by the shortest distance. Each of the first segments is provided with two second segments. The two second segments are arranged symmetrically with respect to an axis extending in the direction in which the first segment extends. The third segments extend along the circumference of the central portion 21. Each of the third segments is connected to two second segments at the two ends thereof, respectively, in the direction in which the third segment extends. The third segment is connected to the first segment at the center thereof in the direction in which the third segment extends.

Figure 7B:
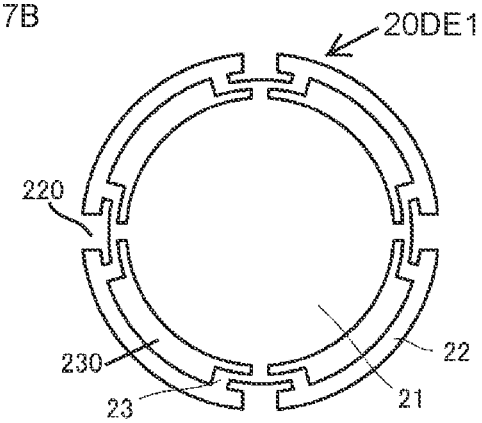

FIG. 7B illustrates a first major plate 20DE1, which is different from the first major plate 20 illustrated in FIG. 7A in the shape of the frame portion 22. The frame portion 22 has indentations 220 each provided between positions where the two second segments of a corresponding one of the supporting portions 23 are connected to the frame portion 22. The indentations 220 may be provided at any other positions of the frame portion 22, except the positions where the second segments of the supporting portions 23 are connected to the frame portion 22.

Figure 7C:
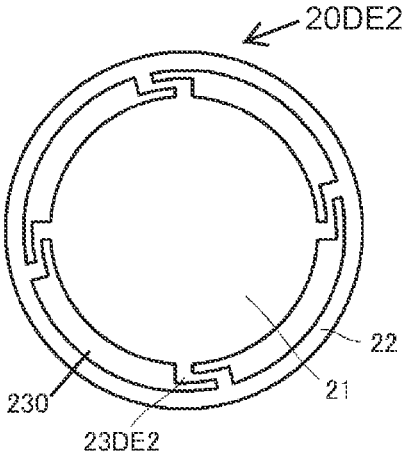

FIG. 7C illustrates a first major plate 20DE2, which is different from the first major plate 20 illustrated in FIG. 7A in the shape of the supporting portions 23DE2. The supporting portions 23DE2 are each obtained by omitting one of the two second segments from the supporting portion 23.

Figure 7D:
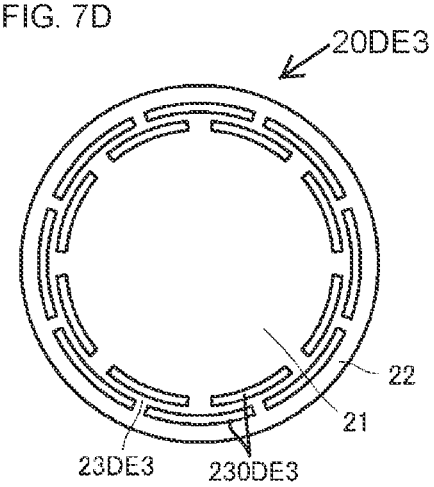

FIG. 7D illustrates a first major plate 20DE3, which is different from the first major plate 20 illustrated in FIG. 7A in the shapes of the first openings 230DE3, and the supporting portions 23DE3. The first openings 230DE3 are obtained from two cuts having different diameters. The two cuts each extend through the first major plate 20 in the thickness direction of the first major plate 20. That is, the two cuts each connect the first major surface 211 and the second major surface 212. The two cuts are each sectioned into a plurality of cuts at a plurality of positions in the circumferential direction. The positions where the group of cuts on the inner side are sectioned are different from the positions where the group of cuts on the outer side are sectioned. The portions that section each of the two groups of cuts serve as the supporting portions 23DE3.

Figure 7E:
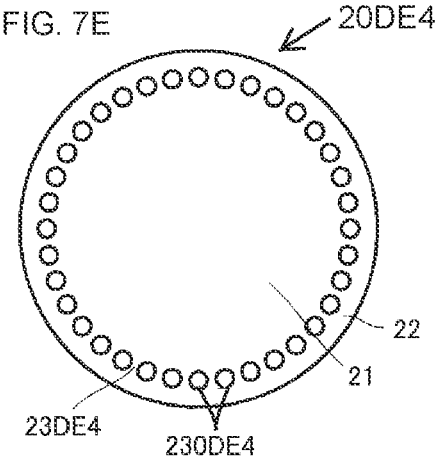

FIG. 7E illustrates a first major plate 20DE4, which is different from the first major plate 20 illustrated in FIG. 7A in the shapes of the first openings 230DE4, and the supporting portions 23DE4. The first openings 230DE4 are a plurality of through-holes arranged on the circumference of a circle. The portions between the plurality of through-holes serve as the supporting portions 23DE4.

Figure 8:
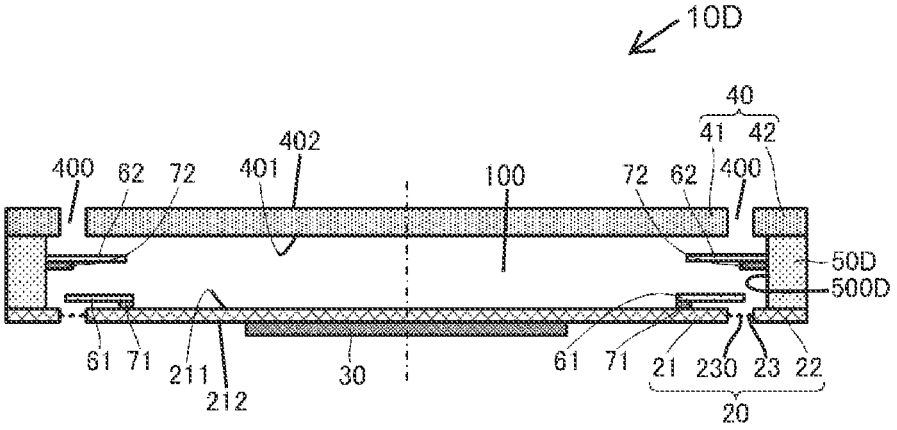
FIG. 8 is a sectional view of a fluid control apparatus according to a derivative example.

The above embodiments each employ the rectification base member. Alternatively, the rectifying members may be fixed directly to the peripheral plate. FIG. 8 is a sectional view of a fluid control apparatus according to a derivative example.

As illustrated in FIG. 8, the fluid control apparatus 10D is different from the fluid control apparatus 10 according to the first embodiment in the configuration of the second film 62 and the fixing member 72. The other details of the fluid control apparatus 10D are the same as those of the fluid control apparatus 10, and the description of such details is omitted.

The fluid control apparatus 10D includes a peripheral plate 50D. The peripheral plate 50D is connected to the first major plate 20 and to the second major plate 40. The peripheral plate 50D has an inner wall surface 500D.

A portion of the second film 62 that is near the outer end is fixed to the inner wall surface 500D of the peripheral plate 50D with the fixing member 72 interposed therebetween.

Such a configuration also produces the advantageous effects produced by the above embodiments.

In each of the above embodiments, the first film or the second film may include a portion that extends from the fixed end toward a side opposite to the movable portion. Such a configuration also includes the configuration according to the present disclosure and produces the advantageous effects produced by the present disclosure.

The configurations according to the above embodiments may be combined according to need. Such combinations each produce corresponding advantageous effects.

10, 10A, 10B, 10C, 10D: fluid control apparatus
20, 20A, 20DE1, 20DE2, 20DE3, 20DE4: first major plate
21, 21A, 21B: central portion
22: frame portion
23, 23DE2, 23DE3, 23DE4: supporting portion
30: piezoelectric device
40: second major plate
41: central portion
42: peripheral portion
50, 51, 52, 50D: peripheral plate
61, 61C: first film
62, 62C: second film

71, 71C, 72, 72C: fixing member
80: rectification base member
100: pump chamber
211: first major surface
212: second major surface
230, 230DE3, 230DE4: first opening
251: first region
252: second region
400: second opening
401: third major surface
402: fourth major surface
411: recess
500D: inner wall surface
801, 802: major surface
N21: node

The invention claimed is:

1. A fluid control apparatus comprising:

a first major plate having a first major surface and a second major surface;

a second major plate having a third major surface and a fourth major surface, the third major surface facing the first major surface;

a peripheral plate connecting the first major plate and the second major plate to each other; and a pump chamber enclosed by the first major plate, the second major plate, and the peripheral plate, wherein the first major plate includes a central portion; a frame portion provided around a circumference of the central portion; a supporting portion connected to the frame portion and to the central portion and supporting the central portion to make the central portion vibratable; and a first opening provided between the central portion and the frame portion and connecting the pump chamber and an outside area near the second major surface to each other, wherein the second major plate includes a second opening connecting the pump chamber and an outside area near the fourth major surface to each other and provided at a position at least partially coinciding with the supporting portion or the frame portion when seen in a direction from the first major plate toward the second major plate, wherein the fluid control apparatus further includes a piezoelectric device provided on the central portion and configured to vibrate the central portion;

a first rectifying member provided between the first major plate and the second major plate in a sectional view of the apparatus and being capable of switching, with vibration of the central portion, a state of connection of the pump chamber and the outside area near the second major surface through the first opening between a connected state of the first opening and a disconnected state of the first opening, wherein the first rectifying member includes a first film; and a second rectifying member provided between the second major plate and the first rectifying member in the sectional view of the apparatus and being capable of switching, with vibration of the central portion, a state of connection of the pump chamber and the outside area near the fourth major surface through the second opening between a connected state of the second opening and a disconnected state of the second opening, wherein the second rectifying member includes a second film, wherein when the first rectifying member establishes the connected state of the first opening where the pump chamber is connected to the outside area near the second major surface, the second rectifying member establishes the disconnected state of the second opening where the pump chamber at the central portion is disconnected from the outside area near the fourth major surface, and wherein when the first rectifying member establishes the disconnected state of the first opening where the pump chamber at the central portion is disconnected from the outside area near the second major surface, the second rectifying member establishes the connected state of the second opening where the pump chamber at the central portion is connected to the outside area near the fourth major surface.

2. The fluid control apparatus according to claim 1, further comprising:

a rectification base member projecting from an inner wall of the peripheral plate and positioned between the first major plate and the second major plate, wherein the second rectifying member is provided on a surface of the rectification base member, the surface facing the second major plate.

3. The fluid control apparatus according to claim 2, wherein the rectification base member does not coincide with any part of the central portion when seen in the direction from the first major plate toward the second major plate.

4. The fluid control apparatus according to claim 1, wherein the first rectifying member further includes a first fixing member, wherein the first film is flexible and annular, and the first fixing member fixes a portion of the first film in such a manner as to form a first fixed end and a first movable portion in the first film, and wherein the second rectifying member further includes a second fixing member, wherein the second film is flexible and annular, and the second fixing member fixes a portion of the second film in such a manner as to form a second fixed end and a second movable portion in the second film.

5. The fluid control apparatus according to claim 4, wherein the first film is fixed to the first fixing member with the first movable portion being farther from the central portion than the first fixed end, and wherein the second film is fixed to the second fixing member with the second movable portion being closer to the central portion than the second fixed end.

6. The fluid control apparatus according to claim 4, wherein the first film is fixed to the first fixing member with the first movable portion being closer to the central portion than the first fixed end, and wherein the second film is fixed to the second fixing member with the second movable portion being farther from the central portion than the second fixed end.

7. The fluid control apparatus according to claim 1, wherein an average thickness of the central portion is greater in a region on a center side with respect to an outermost vibration node of the central portion than in a region on an outer side with respect to the outermost vibration node.

8. The fluid control apparatus according to claim 2, wherein the first rectifying member further includes a first fixing member, wherein the first film is flexible and annular, and the first fixing member fixes a portion of the first film in such a manner as to form a first fixed end and a first movable portion in the first film, and wherein the second rectifying member further includes a second fixing member, wherein the second film is flexible and annular, and the second fixing member fixes a portion of the second film in such a manner as to form a second fixed end and a second movable portion in the second film.

9. The fluid control apparatus according to claim 3, wherein the first rectifying member further includes a first fixing member, wherein the first film is flexible and annular, and the first fixing member fixes a portion of the first film in such a manner as to form a first fixed end and a first movable portion in the first film, and wherein the second rectifying member further includes a second fixing member, wherein the second film is flexible and annular, and the second fixing member fixes a portion of the second film in such a manner as to form a second fixed end and a second movable portion in the second film.

10. The fluid control apparatus according to claim 2, wherein an average thickness of the central portion is greater in a region on a center side with respect to an outermost vibration node of the central portion than in a region on an outer side with respect to the outermost vibration node.

11. The fluid control apparatus according to claim 3, wherein an average thickness of the central portion is greater in a region on a center side with respect to an outermost vibration node of the central portion than in a region on an outer side with respect to the outermost vibration node.

12. The fluid control apparatus according to claim 4, wherein an average thickness of the central portion is greater in a region on a center side with respect to an outermost vibration node of the central portion than in a region on an outer side with respect to the outermost vibration node.

13. The fluid control apparatus according to claim 5, wherein an average thickness of the central portion is greater in a region on a center side with respect to an outermost vibration node of the central portion than in a region on an outer side with respect to the outermost vibration node.

14. The fluid control apparatus according to claim 6, wherein an average thickness of the central portion is greater in a region on a center side with respect to an outermost vibration node of the central portion than in a region on an outer side with respect to the outermost vibration node.

* * * * *